US009128466B2

(12) United States Patent
Monferrer et al.

(10) Patent No.: US 9,128,466 B2
(45) Date of Patent: Sep. 8, 2015

(54) CORRECTION DEVICE FOR FUNCTIONS DISPLAYED BY A TIMEPIECE

(71) Applicant: BLANCPAIN SA, Le Brassus (CH)

(72) Inventors: Bernat Monferrer, Le Lieu (CH); Marco Rochat, Le Brassus (CH)

(73) Assignee: BLANCPAIN SA, Le Brassus (CH)

( * ) Notice: Subject to any disclaimer, the term of this patent is extended or adjusted under 35 U.S.C. 154(b) by 0 days.

(21) Appl. No.: 13/957,938

(22) Filed: Aug. 2, 2013

(65) Prior Publication Data

US 2014/0056114 A1 Feb. 27, 2014

(30) Foreign Application Priority Data

Aug. 21, 2012 (EP) ..... 12181207

(51) Int. Cl.
*G04B 27/02* (2006.01)
*G04B 27/00* (2006.01)

(52) U.S. Cl.
CPC ..... *G04B 27/002* (2013.01); *G04B 27/026* (2013.01)

(58) Field of Classification Search
CPC ..... G04B 27/002; G04B 27/026
USPC ..... 368/190–192, 206, 319
See application file for complete search history.

(56) References Cited

U.S. PATENT DOCUMENTS

| | | | | |
|---|---|---|---|---|
| 3,675,411 | A * | 7/1972 | Sakuma | 368/27 |
| 3,702,530 | A * | 11/1972 | Besson et al. | 368/35 |
| 3,748,848 | A * | 7/1973 | Laesser et al. | 368/31 |
| 4,423,964 | A * | 1/1984 | Griessen et al. | 368/74 |
| 6,711,099 | B1 * | 3/2004 | Mock et al. | 368/31 |
| 7,441,945 | B2 * | 10/2008 | Laucella et al. | 368/190 |
| 7,445,374 | B2 * | 11/2008 | Forsey et al. | 368/101 |

FOREIGN PATENT DOCUMENTS

| | | |
|---|---|---|
| CH | 700 531 A2 | 9/2010 |
| EP | 2 214 066 A1 | 8/2010 |
| EP | 2 367 074 A1 | 9/2011 |
| EP | 2 444 861 A1 | 4/2012 |

OTHER PUBLICATIONS

Translation EP 2367074—epo.org; Jul. 24, 2014.*
Translation EP 2214066—epo.org; Jul. 24, 2014.*

* cited by examiner

*Primary Examiner* — Sean Kayes
(74) *Attorney, Agent, or Firm* — Sughrue Mion, PLLC

(57) ABSTRACT

The present invention relates to a correction device for changing the data of a plurality N of time-related functions displayed by a timepiece. It is characterized in that the device includes a pusher (1) for changing function, whose actuation moves a control wheel (2) and meshes said wheel with a corrector pinion (3, 4, 5) for the selected function, and a stem (7) whose rotation in one direction or the other pivots said control wheel (2), which in turn drives one of said corrector pinions (3, 4, 5) to correct the data of said selected function by adding or subtracting.

9 Claims, 6 Drawing Sheets

Fig. 4
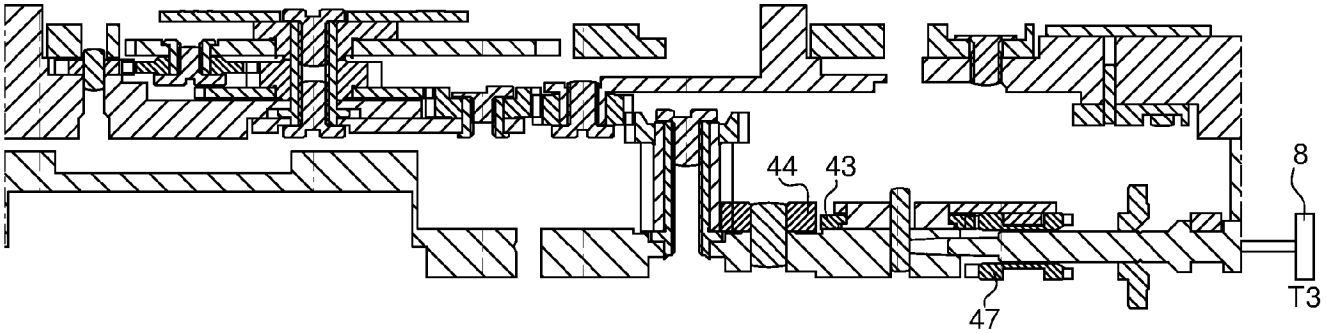
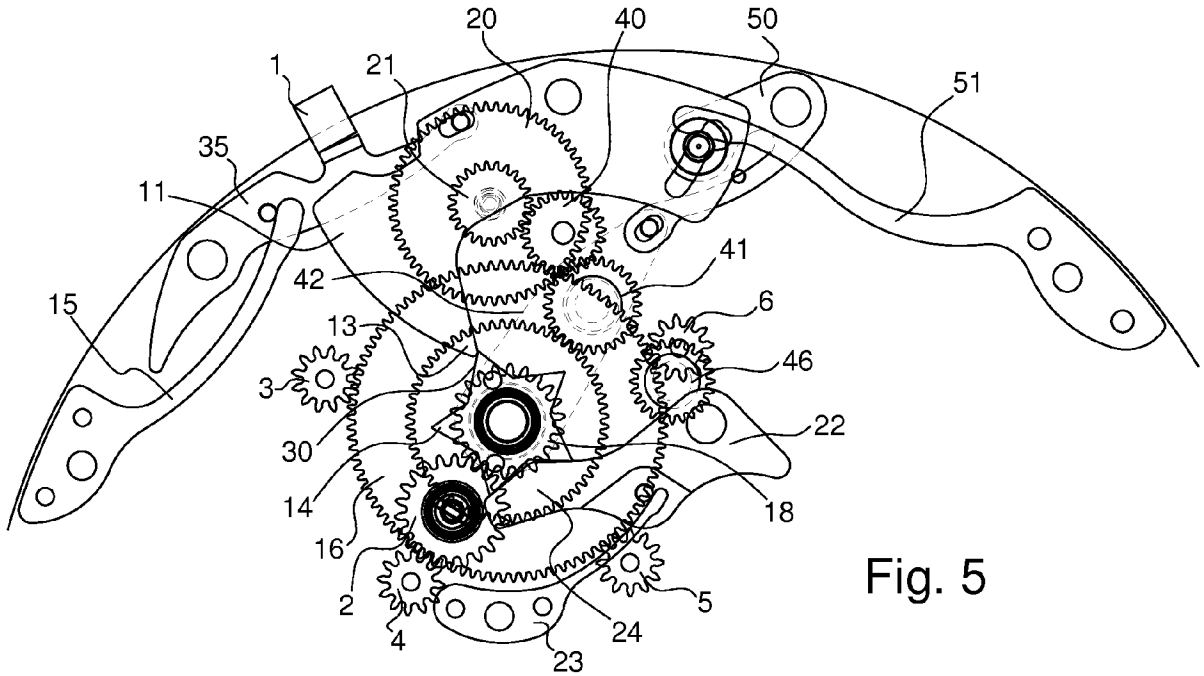
Fig. 5

CORRECTION DEVICE FOR FUNCTIONS DISPLAYED BY A TIMEPIECE

This application claims priority from European Patent Application No. 12181207.7 filed Aug. 21, 2012, the entire disclosure of which is incorporated herein by reference.

FIELD OF THE INVENTION

The present invention relates to a correction device for changing the data of a plurality N of time-related functions displayed by a timepiece.

To perform these corrections, most timepieces employ a stem-crown which can be placed in first and second pulled-out positions to select the date and time-setting functions respectively, the correction being performed by rotating the crown. The advantage of this system lies in the two-directional correction of the data to be modified but the choice is limited to the correction of two functions. If other functions require correction, for example the day of the week and the month, a second stem-crown could be added to the middle part of the timepiece with the technical complications and lack of aesthetic appeal that this solution would involve.

The required corrections may also be implemented by pushers, each of which corrects a displayed item of time data. Often, these pushers are correctors embedded in the middle part of the timepiece, which does not detract from the aesthetic appeal of the assembly. However, the main drawback of this solution lies in its one-directional operation, along with the possibility of the mechanism breaking if two pushers are actuated at the same time.

Watchmakers therefore feel the need to design a system which associates pushers and stem-crowns, with the pusher selecting the function from among several available functions and the stem-crown correcting the function in both directions.

A draft of the aforecited system is proposed in CH Patent Application No 700531 A2. That Patent Application provides a pusher for changing function and a stem for correcting the selected function, with the stem being driven in rotation by a serrated ring which can be moved manually around the middle part of the timepiece. Each separate press on the pusher (i.e. a press, followed by a release of pressure) changes the function to be corrected by the ring. For example, starting from a winding function, a first press selects the time-setting function, a second press selects the date-setting function, and a third press will again select the winding function. The present system provides a device displaying the function fulfilled by the ring during rotation. This system is not dissimilar to a conventional watch control system since it uses a sliding pinion mounted on the stem. It will thus be clear that the number of functions displayed by the watch is limited to two units, namely setting the time and the date.

Thus, if a system is to be implemented which is capable of correcting more than two time-related data items displayed by the timepiece in both directions, but still with the idea of using a pusher to select the displayed data item and a stem to correct said data item, an alternative approach must be found to using the sliding pinion, this approach being that proposed by the present invention, which is characterized in that it includes a pusher for changing function, whose actuation moves a control wheel causing said wheel to mesh with a corrector pinion for the selected function, and a stem covered with a crown, whose rotation in one direction or the other causes said control wheel to pivot, which in turn drives one of said corrector pinions to correct said selected function data by adding or subtracting (in one direction or the opposite direction).

The features and advantages of the present invention will appear from the following description, given with reference to the annexed drawings, and providing, by way of explanatory, but non-limiting example, a preferred embodiment of the invention. In the drawings:

FIG. 1 is a plan view of the assembly of the present invention wherein the timepiece is provided with a pusher 1 for changing function, said function being provided with a first corrector pinion 4 meshing with a control wheel 2, and a correction stem 7 for the selected function, said stem being in a first, pulled-out, axial position T2.

FIG. 4 is a cross-section along the line A-A of FIG. 1, with the stem in a second pulled-out axial position T3.

FIG. 5 shows a plan view of a first function change phase when pusher 1 starts to be actuated, with control wheel 2 still meshing with corrector pinion 4.

Figure 6:
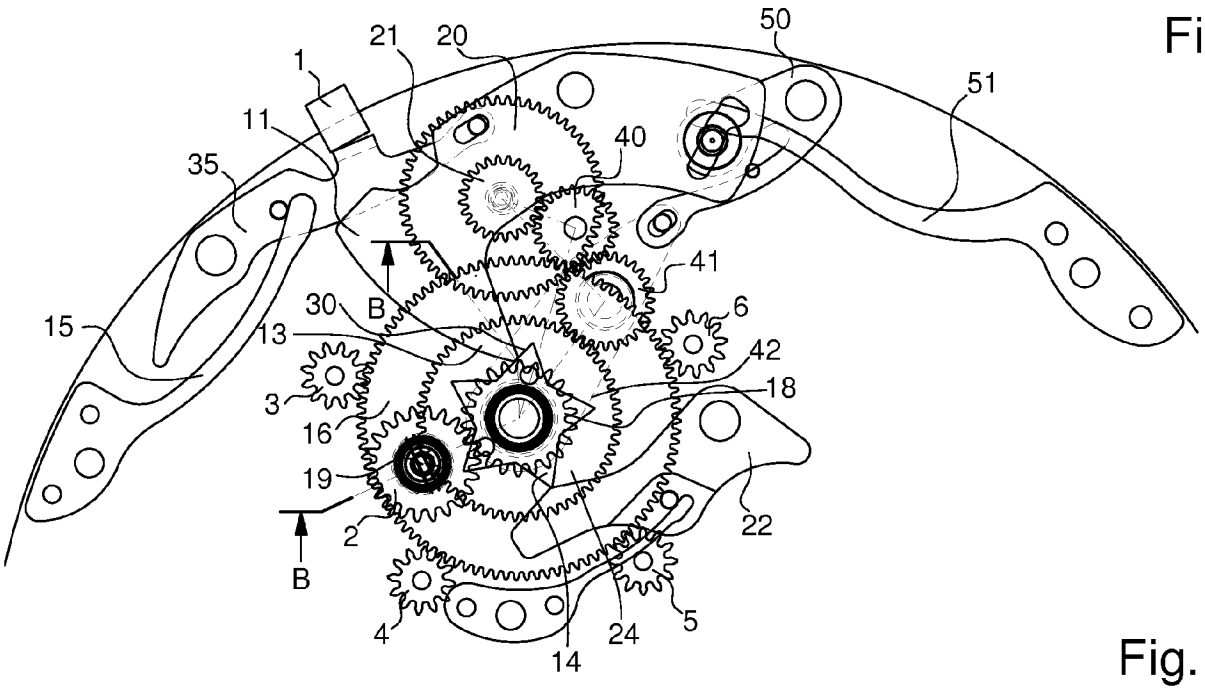

FIG. 6 shows a plan view of a second function change phase, with pusher 1 continuing to be actuated, control wheel 2 being half-way between two corrector pinions 4 and 3 corresponding to two different functions.

Figure 7:
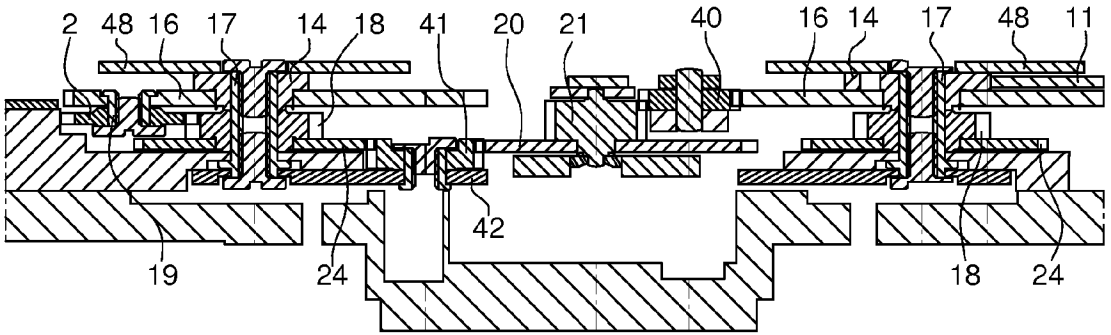

FIG. 7 is a cross-section along the line B-B of FIG. 6.

Figure 8:
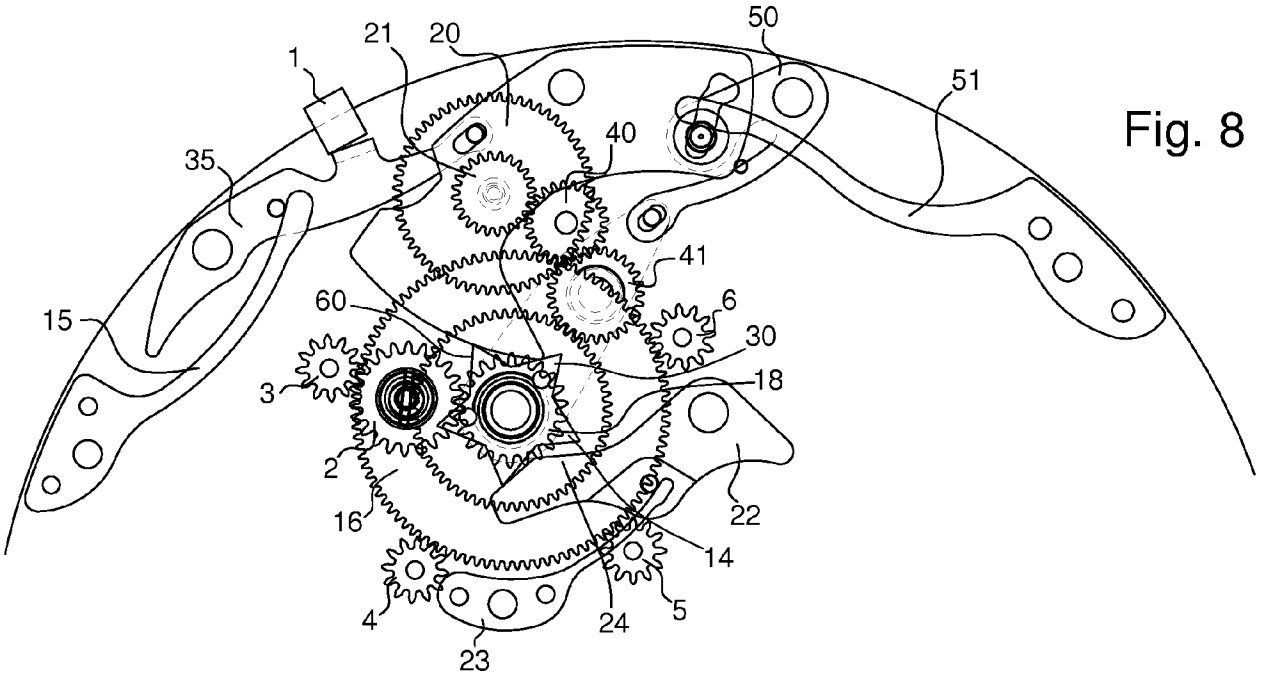

FIG. 8 shows a plan view of a third function change phase, with actuation of the pusher ending, and control wheel 2 being close to the end of meshing with the new corrector pinion 3.

Figure 9:
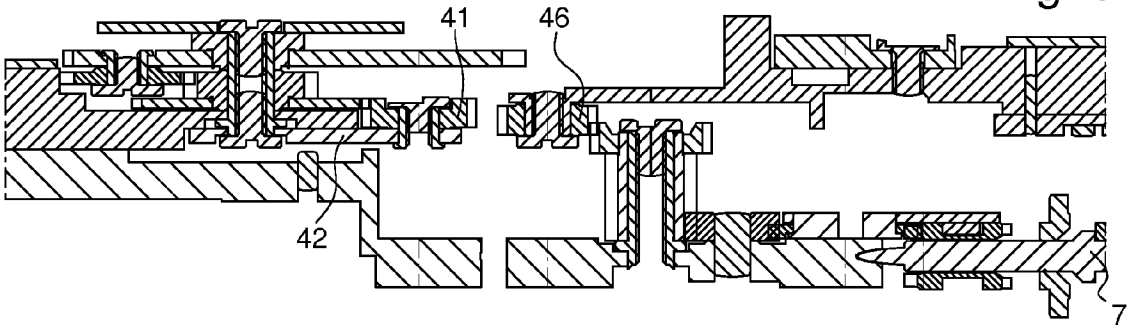

FIG. 9 is a cross-section of the device according to the invention, with control wheel 2 being situated between corrector pinions 4 and 3, and the stem being inadvertently set in rotation during a function change.

Figure 10:
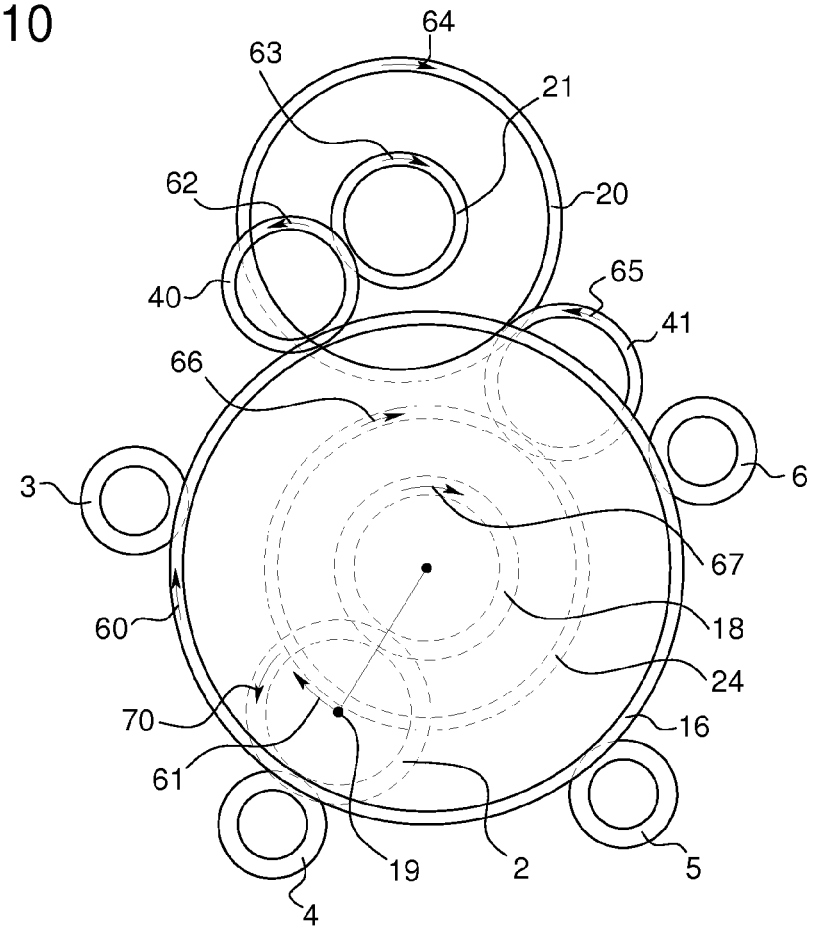

FIG. 10 shows the existing kinematic change when pusher 1 is actuated.

Figure 11:
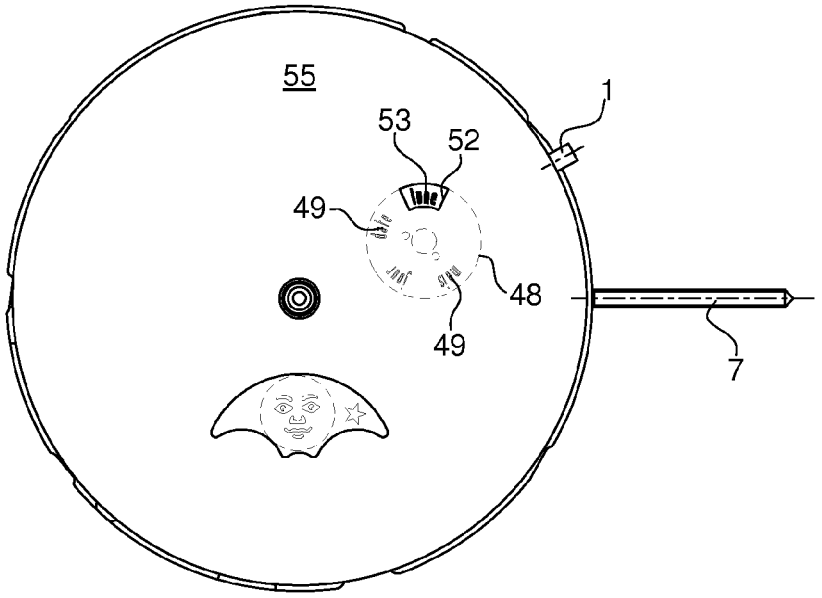

FIG. 11 is a plan view of the timepiece in which a function data item and the written display of this data item appear through apertures.

Figure 1:
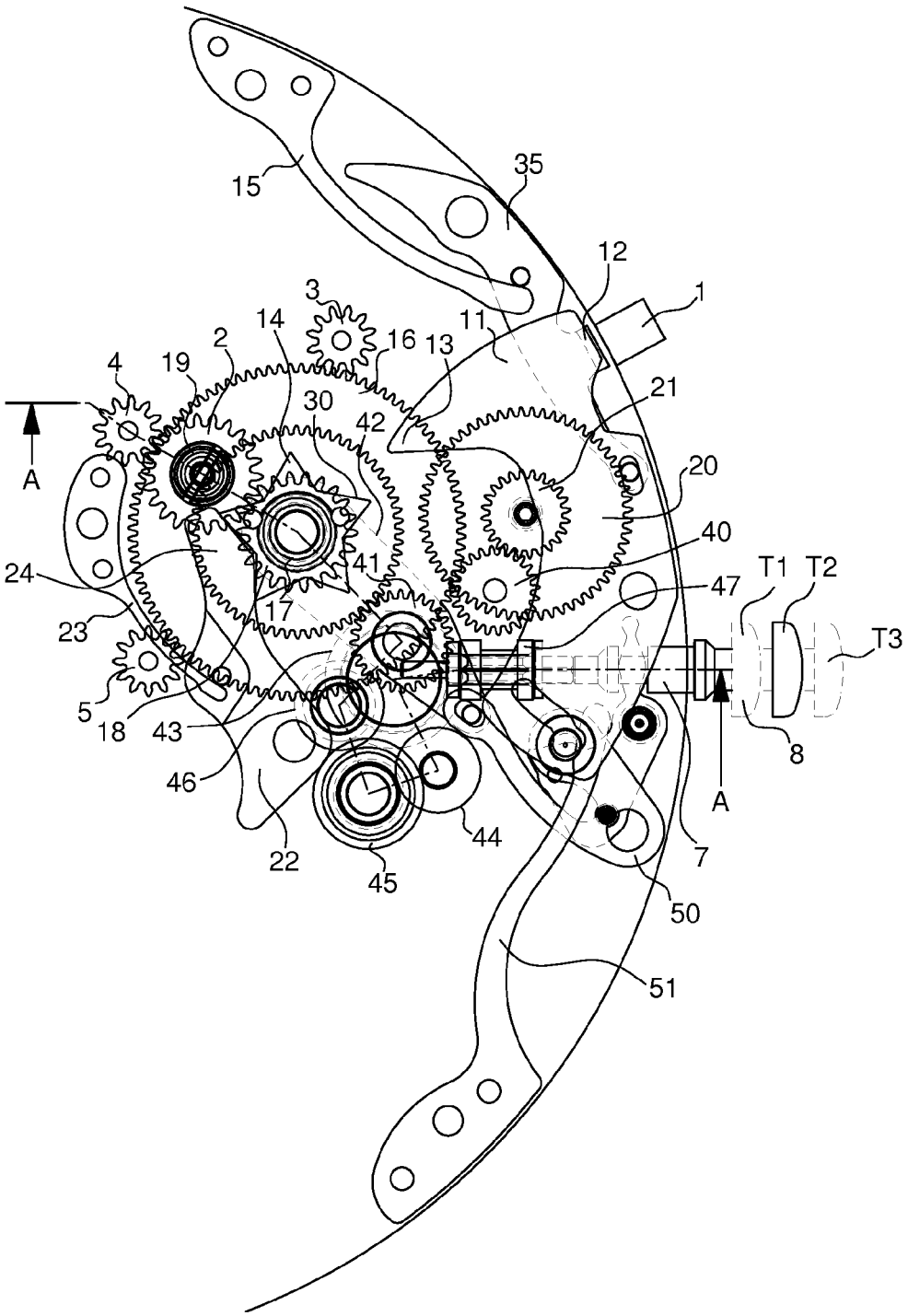

The general principle of the present invention is shown in FIG. 1. The timepiece is provided with a correction device for changing the data of a plurality N of time-related functions displayed by said timepiece. The invention is characterized in that the device includes, on the one hand, a pusher 1 for changing function, whose actuation, i.e. a press, then release of pressure on said pusher 1, moves a control wheel 2. As the timepiece includes a plurality N of time-related functions, each function is provided with a corrector pinion for the selected function respectively referenced 3, 4, 5 or 6 in FIG. 1. These corrector pinions are linked to the function for the correction thereof by a mechanism which is not described here, but which can correct the selected function, for example the date, day of the week, month, time-setting or even the moon phase. The device of the invention includes, on the other hand, a stem 7 covered with a crown 8, whose rotation in one direction or the other causes control wheel 2 to pivot, which in turn drives one of the corrector pinions 3, 4, 5 or 6 to correct the selected function data by adding or subtracting. In a very simplified version of the invention, it is possible to envisage a stem with no axial movement, winding being achieved via an oscillating weight and the time-setting by the device of the present invention.

In a more elaborate version of the present invention and as shown in FIG. 1, stem 7 can take three axial positions, a pushed-in "operating" position T1, in which it is possible to manually wind the timepiece, a first pulled-out position T2 for correcting the data of the selected time-related function according to the present invention, and a second pulled-out position T3 for setting the time of the timepiece using known means.

Finally, in a preferred version of the invention, FIG. 1 shows that actuating pusher 1 causes the arbour 19 of control wheel 2 to cover a circular trajectory. Here, each of corrector pinions 3, 4, 5, 6 is arranged around said trajectory, the primitive radius of each of said corrector pinions being dimensioned to mesh with the primitive radius of control wheel 2. It should be noted that corrector pinion 6 is not shown in FIG. 1 to avoid complicating said FIG. However, this pinion 6 appears in FIG. 10 which allows it to be shown.

Moreover, in the preferred version described in the paragraph above, the device of the invention is made so that when pusher 1 is actuated, simultaneously with the movement of control wheel arbour 19 in a circular trajectory, control wheel 2 rotates on itself and does not drive function corrector pinion (3, 4, 5, 6) with which it is made to mesh.

There will now be described in detail the composition of the device of the invention, embodied in the aforementioned preferred version and in the more elaborate version where stem 7 may be disposed in three different axial positions. With this aim, reference will mainly be made to FIG. 1 which is a plan view and to FIGS. 2 and 7 which are cross-sections of the device of the invention, with stem 7 in the first axial pulled-out position T2. The device includes:

- a system of levers formed of two elements 11 and 35 and returned by a first spring 15. This system is provided with a heel 12, on which the function change pusher 1 presses, and a beak 13. Beak 13 is arranged to actuate the teeth 30 of a star 14. Star 14 has a number N of teeth 30 equal to the number of time functions to be corrected. The space between two teeth 30 of star 14 is occupied by a jumper spring 22 when lever system 11 and 35 is not being actuated by pusher 1. Jumper spring 22 is returned by a second spring 23,
- a star wheel 16 coaxially fixed to star 14 to form a first assembly which rotates freely on a first arbour 17. A second assembly, formed of a central wheel 24 on which a central pinion 18 is coaxially fixed, rotates freely about this first arbour 17,
- a second arbour 19 fixed off-centre to star wheel 16 to act as an axis of rotation about which control wheel 2 rotates freely. Control wheel 2 meshes, like a planetary wheel, on central pinion 18. Said control wheel 2 is meshed with one of said function corrector pinions 3, 4, 5, 6, with corrector pinion 4 here,
- a third assembly formed of a main intermediate wheel 20 to which a main intermediate pinion 21 is fixed. Main intermediate pinion 21 meshes with star wheel 16 via a first intermediate wheel 40, and
- a second intermediate wheel 41 permanently meshing with central wheel 24. This second intermediate wheel 41 is capable of being driven either by main intermediate wheel 20, as shown in FIG. 7, or by a last wheel set 46 of a gear train 47, 43, 44, 45, 46 controlled by stem 7, as shown in FIGS. 1 and 2.

To make it possible for the second intermediate wheel 41 to engage either on main intermediate wheel 20, or on the last wheel set 46 controlled by stem 7, the second intermediate wheel 41 is mounted on an uncoupling arm 42 pivoting about the first arbour 17, on which the first and second assemblies rotate freely. Uncoupling arm 42 is controlled by a control lever 50 returned by a third spring 5, said lever 50 being controlled by the lever system 11 and 35 actuated by pusher 1.

In the particular case shown in the FIGS., the number of teeth 30 of star 14 is not N but a number N+1, in order to provide an additional "rest" function in which control wheel 2 is not meshed with any of the corrector pinions. Thus in the case shown, star 14 is provided with five teeth 30 disposed at 72° with respect to each other, the corrector pinions being reduced to four, still arranged at 72° with respect to each other.

Figure 2:
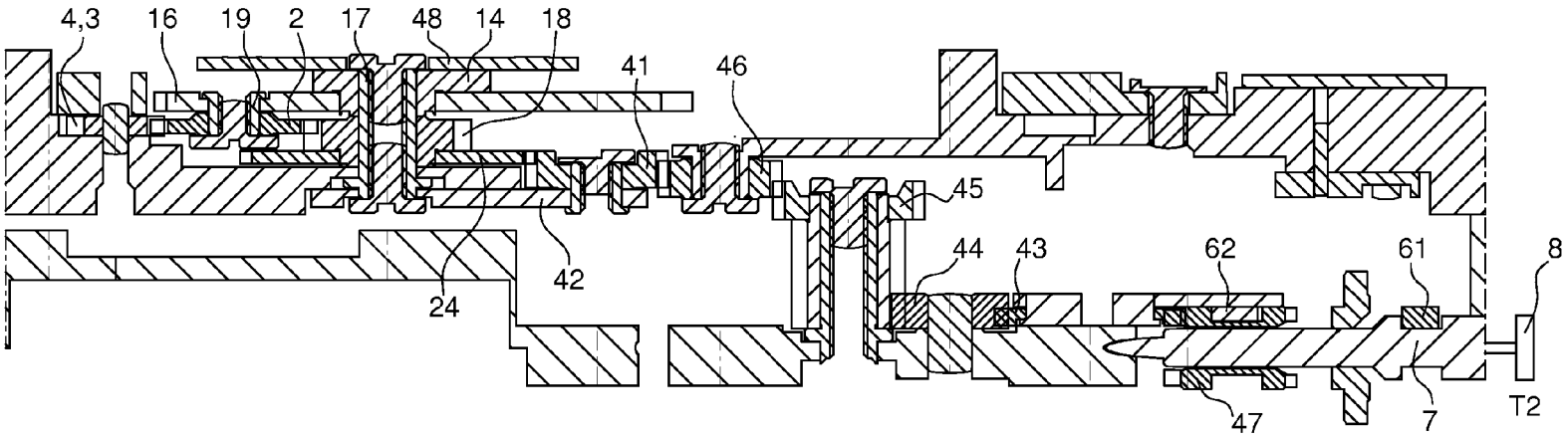
FIG. 2 is a cross-section along the line A-A of FIG. 1.

As can be seen in FIG. 2 and more clearly in FIG. 11, the first assembly formed of star 14 and star wheel 16 carries a disc 48 where the various correctable functions 49 are inscribed, correctable function 53 appearing in an aperture 52 made in dial 55 of the timepiece.

As shown in FIG. 2, which is a cross-section along the line A-A of FIG. 1, the second intermediate wheel 41 is kinematically connected to stem 7 by a gear train comprising wheel sets 47, 43, 44, 45 and 46, with stem 7 in the first pulled-out position T2. More specifically, this gear train has a sliding pinion 60 sliding on stem 7, sliding pinion 60 and stem 7 being connected by a known state of the art pull-out piece 61-lever 62 system.

When stem 7 is driven in rotation, it drives a first intermediate wheel 43, which in turn drives a second intermediate wheel 44, which is meshed with an intermediate wheel set 45 actuating an bottom plate-plate 46 intermediate wheel, with wheel 46 meshing finally with second intermediate wheel 41. In this situation and if control wheel 2 is oriented towards the additional rest function in which said control wheel 2 is not meshed with any of the corrector pinions (a situation which is not shown here), jumper spring 22 locks star 14 and a rotational motion of stem 7 transmits this motion to control wheel 2, which turns idly.

Figure 3:
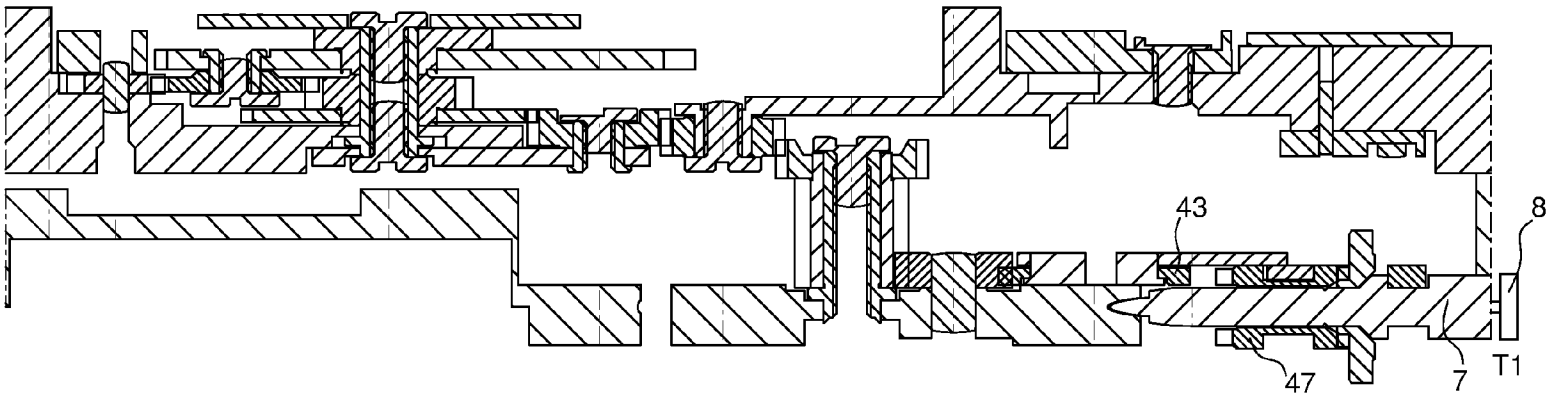
FIG. 3 is a cross-section along the line A-A of FIG. 1 with the stem in a pushed-in axial position T1.

FIG. 3 shows the situation of the mechanism described with reference to FIG. 2 in the case where stem 7 is in the pushed-in position T1. In this case, any connection of sliding pinion 47 to the rest of the gear train is interrupted, since the sliding pinion is driving the winding of the timepiece barrel. In this case, control wheel 2 may be oriented towards any function.

FIG. 4 shows the situation of the mechanism described in FIG. 2 in the case where stem 7 is in the second pulled-out position T3. Sliding pinion 47 is meshed with first intermediate wheel 43, which in turn drives the time-setting mechanism (not shown). In this case, the connection of the first intermediate wheel 43 to second intermediate wheel 44 is interrupted. As in situation T1, control wheel 2 may be oriented towards any function.

The function change is achieved by a press on pusher 1 followed by a complete release of pressure. Various phases of this change will now be described with reference to FIGS. 5 to 10, where FIGS. 5, 6, 7, 8 and 10 are drawings showing the elements necessary for this change, to the exclusion of element necessary for correcting the selected function, i.e. the stem and gear train connected thereto.

FIG. 5 is a plan view of a first function change phase. The start of pressure on pusher 1 causes beak 13 of lever system 11, 35 to enter into contact with a tooth 30 of star 14. Star 14 is still immobile. At the same time, lever system 11, 35 acts on control lever 50, which pivots uncoupling arm 42 and the second intermediate wheel connected thereto. This second intermediate wheel 41 then leaves the last wheel set 46 of the gear train which connects it to stem 7 and meshes with main intermediate wheel 20. At that moment, arbour 19 of control wheel 2 connected to star wheel 16 is able to move on a circular trajectory at the same time as the control wheel rotates on itself due to the engagement thereof with central pinion 18.

FIG. 6 is a plan view of a second function change phase where pusher 1 continues to be actuated and FIG. 7 is a cross-section along line B-B of FIG. 6. In this situation, beak 13 drives star 14 via one flank of tooth 30 thereof, and then star wheel 16 which is connected thereto; said star wheel 16 driving arbour 19 of control wheel 2, which is approximately half-way between two corrector pinions 4 and 3, in a circular trajectory.

FIG. 8 is a plan view of a third function change phase with the pusher at the end of actuation. In this situation, the control wheel is close to completely meshing with the new corrector pinion 3, with complete meshing occurring at the moment when pusher 1 is released. When pusher 1 is released, the situation is as shown in FIGS. 1 and 2. Jumper spring 22 locks the star between two of its teeth and second intermediate wheel 41, under the action of uncoupling arm 42, has left main intermediate wheel 20 to mesh again with the last wheel set 46 of the gear train which connects it to stem 7. From that moment, control wheel 2 and the new corrector pinion 3 are driven by the rotation of stem 7.

The important role played by second intermediate wheel 41 was explained above, said wheel 41 meshing, on the one hand, permanently like a planetary wheel with central wheel 24, and on the other hand, either with main intermediate wheel 20 when pusher 1 is actuated to perform a function change, or with the last wheel set 46 of the gear train ending with the stem to perform a correction of the selected function.

FIG. 9 is a cross-section of the mechanism during a function change, with control wheel 2 between two function corrector pinions 4 and 3. At that moment, the last wheel set 46 of the gear train controlled by stem 7 no longer meshes with the second intermediate wheel 41; said last wheel set 46 is turns idly, even if stem 7 is inadvertently driven in rotation during a function change operation performed by the pusher.

FIG. 10 is a schematic view of the kinematic chain involved when pusher 1 is actuated. From that moment, star 14 (not shown) rotates star wheel 16 in the direction of arrow 60. Arbour 19 of control wheel 2 fixed to star wheel 16 advances in the direction of arrow 61 on a circular trajectory as seen above. Control wheel 2 passes from corrector pinion 4 to corrector pinion 3 during the pressing and release of pusher 1. Simultaneously with this movement, control wheel 2 will rotate on itself along the direction of arrow 70, so that the rotation thereof first leaves immobile corrector pinion 4, which it leaves, and then corrector pinion 3 with which it engages. This precaution is essential because without it the displayed functions would be completely disrupted or displaced. It will be clear that to maintain this immobility, control wheel 2 has to rotate in an opposite direction 70 to the direction 60 of star wheel 16 which is the same as the direction of rotation 61 of arbour 19 of control wheel 2. The rotation and direction of rotation of control wheel 2 are governed in order and starting from star wheel 16, which rotates in the direction of arrow 60, by the following wheel sets driven by said star wheel 16: first intermediate wheel 40 (direction of arrow 62), main intermediate pinion 21 (arrow 63), main intermediate wheel 20 (arrow 64), second intermediate wheel 41 (arrow 65), central wheel 24 (arrow 66), central pinion 18 (arrow 67) and control wheel 2 (arrow 70).

Since the direction of rotation 70 of control wheel 2 is opposite to the direction of rotation 60 of the star wheel, the primitive radii of the wheel sets forming the aforementioned kinematic chain need to be dimensioned so that the angular movement of control wheel 2 is such that it leaves immobile the corrector pinion (3, 4) which it leaves or with which it engages. Mathematical evolutions established two equations which, if satisfied, ensure the desired result, namely $$2 + 2\frac{R(18)}{R(2)} - \frac{R(16)\cdot R(20)\cdot R(18)}{R(21)\cdot R(24)\cdot R(2)} = 0$$

$$R(24) + R(20) = R(21) + R(16)$$

It should be noted that the primitive radii of the corrector pinions (3 to 6) and the radii of the first and second intermediate wheels do not appear in these equations and can thus be chosen freely. Further, the table below gives a practical embodiment example:

| | Primitive radius R (mm) | Module m (mm) | Number of teeth Z |
|---|---|---|---|
| R(18) | 1.21 | 0.11 | 22 |
| R(24) | 2.25 | 0.075 | 60 |
| R(16) | 3.6 | 0.075 | 96 |
| R(2) | 1.21 | 0.11 | 22 |
| R(4) | 0.66 | 0.11 | 12 |
| R(21) | 0.9 | 0.075 | 24 |
| R(20) | 2.25 | 0.075 | 60 |
| R(41) | 1.05 | 0.075 | 28 |
| R(40) | 0.9 | 0.075 | 24 |

As soon as pusher 1 is released, control wheel 2 is driven by the rotation of stem 7 which is capable of correcting (by adding or subtracting) the data displayed by the time function selected by pusher 1. This situation is the same as that shown in FIG. 1 except as regards control wheel 2 which is now aligned with corrector pinion 3. FIG. 2 also shows a cross-section of the new situation except as regards the corrector pinion which bears the reference 3.

The rotation of stem 7 drives gear train 47, 43, 44, 45, 46 the last wheel set of which, the bottom plate-plate intermediate wheel 46, meshes finally with central wheel 24 via second intermediate wheel 41. Central wheel 24 drives central pinion 18 which is coaxially connected thereto, said central pinion 18 in turn driving control wheel 2, which finally drives the new function corrector pinion 3 in one direction or the other, according on the direction of rotation imparted on crown 8 covering stem 7.

To conclude this description, it should be emphasised that the present invention is not limited to the particular embodiment of the preferred system described in detail above.

It would be possible, for example, to omit the second intermediate wheel 41 and consequently the first intermediate wheel 40, if the third assembly were formed of a main intermediate wheel 20, friction mounted on main intermediate pinion 21, pinion 21 meshing directly with star wheel 16 and wheel 20 meshing both with the second assembly, formed of central wheel 24 and central pinion 18, and with the gear train connected to stem 7, said train having a radial uncoupling means controlled by the pusher, during the actuation thereof.

In this derivative version, the rest of the mechanism remains the same as that mentioned with reference to the preferred version, the main idea of the present invention consisting in the fact that a function change pusher 1 moves a control wheel 2 and causes it to mesh with a corrector pinion for the selected function and that a stem 7, driven in rotation in one direction or the other, in turn drives the selected corrector pinion to correct, by adding or subtracting, the displayed data of said selected function.

What is claimed is:

1. A correction device for modifying the data of a plurality N of time-related functions displayed by a timepiece including a timepiece movement, the device comprising:

a pusher for changing function, whose actuation moves a control wheel and meshes said wheel with a corrector pinion for the selected function, and a stem covered with a crown whose rotation in one direction or the other pivots said control wheel, which in turn drives one of said corrector pinions to correct the data of said selected function by adding or subtracting, wherein the pusher and the stem are arranged along two separate and distinct radii of the timepiece movement, wherein the pusher is operable from an exterior of the timepiece, and wherein actuation of the pusher causes the arbour of the control wheel to cover a circular trajectory, each of the corrector pinions being arranged around said trajectory, the primitive radius of each of said corrector pinions being dimensioned to mesh with the primitive radius of said control wheel.

2. The device according to claim 1, wherein the stem can take three axial positions, a pushed-in operating position in which it is possible to manually wind the timepiece, a first pulled-out position for correcting the data of the selected time-related function, and a second pulled-out position for setting the time of the timepiece.

3. Device according to claim 1, wherein, when the pusher is actuated, the control wheel, simultaneously with the movement of the arbour thereof on a circular trajectory, rotates on itself so as to hold immobile the corrector pinion that the control wheel leaves and then the corrector pinion with which the control wheel engages.

4. Device according to claim 1, further comprising:

a lever system returned by a first spring, said system being provided with a heel, on which the pusher can abut, and with a beak arranged to actuate the teeth of a star, said star having a number N of teeth equal to the number of time-related functions to be corrected, a jumper spring returned by a second spring occupying the space between said teeth, a star wheel coaxially fixed to the star to form a first assembly rotating freely on a first arbour about which a second assembly, formed of a central wheel on which there is fixed a central pinion, rotates freely, a second arbour fixed to the star wheel acting as an axis of rotation about which the control wheel rotates freely, meshing, like a planetary wheel, about said central pinion, the control wheel meshing with one of said function corrector pinions, a third assembly formed of a main intermediate wheel to which there is fixed a main intermediate pinion, said intermediate pinion meshing with the star wheel via a first intermediate wheel, a second intermediate wheel permanently meshing with the central wheel and being able to be driven either by the main intermediate wheel, or by a last wheel set of a gear train controlled by the stem.

5. Device according to claim 4, wherein the second intermediate wheel is mounted on an uncoupling arm pivoting about the first arbour carrying the central wheel, said uncoupling arm being controlled by a control lever returned by a third spring, said lever being controlled in turn by the lever system actuated by the pusher.

6. Device according to claim 4, wherein the star includes N+1 teeth to provide an additional rest function where the control wheel is not meshed with any of the corrector pinions.

7. Device according to claim 4, wherein the first assembly formed of the star and the star wheel carries a disc where the various correctable functions are inscribed, the correctable function appearing in an aperture made in the dial of the timepiece.

8. Device according to claim 4, wherein a press on the pusher on the one hand moves the control wheel from one function corrector pinion to another function corrector pinion, said pusher advancing the star through one step via the beak of the lever system pressing on one of the teeth of said star, said advancement causing the star wheel and the control wheel carried thereby, to advance to the new position thereof, and, on the other hand, simultaneously with the circular motion of the arbour of the control wheel, rotates said control wheel on itself so that the rotation leaves immobile the corrector pinion that the control wheel leaves and the corrector pinion with which the control wheel engages, the second intermediate wheel being meshed with the main intermediate wheel, and the primitive radii forming the kinematic chain comprising the control wheel, the central pinion, the central wheel, the main intermediate wheel, the main intermediate pinion, and the star wheel being dimensioned to ensure this rotation.

9. Device according to claim 4, wherein the rotation of the stem in one direction or the other corrects, by adding or subtracting, the data displayed by the time-related function selected by the pusher, said pusher being released, said rotation causing the gear train whose last wheel set drives the central wheel via the second intermediate wheel meshing therewith, said central wheel driving the central pinion which is connected thereto, said central pinion in turn driving the control wheel which finally drives the function corrector pinion in one direction or the other.

* * * * *